United States Patent [19]

Tranin

[11] Patent Number: 4,714,021

[45] Date of Patent: Dec. 22, 1987

[54] BURIED SYSTEM COMPRISING A SIGNALIZATION DEVICE

[75] Inventor: Jean-Pierre Tranin, Fontenay Aux Roses, France

[73] Assignee: U.S. Philips Corporation, New York, N.Y.

[21] Appl. No.: 864,167

[22] Filed: May 16, 1986

[30] Foreign Application Priority Data

May 21, 1985 [FR] France ..... 85 07608

[51] Int. Cl.[4] ..... F42B 23/24

[52] U.S. Cl. ..... 102/401

[58] Field of Search ..... 102/401, 404, 426, 427

[56] References Cited

U.S. PATENT DOCUMENTS 4,292,861 10/1981 Thornhill, Jr. et al. ..... 102/401

FOREIGN PATENT DOCUMENTS 3127522 1/1983 Fed. Rep. of Germany ..... 102/401
504434 4/1920 France .
2309829 11/1976 France .
2351378 6/1980 France .
12797 of 1914 United Kingdom ..... 102/404

*Primary Examiner*—Charles T. Jordan
*Attorney, Agent, or Firm*—Robert T. Mayer

[57] ABSTRACT

This buried system (1), which comprises a signalization device (2) constituted by a telescopic arrangement (3) of coaxial tubes (4,5,6,7) by means (8) for increasing the internal pressure in order to develop the telescopic arrangement (3) and by means (9) for controlling the increase of the internal pressure at a given instant, is characterized in that it moreover has means (12) for obtaining the tightness of the telescopic arrangement (3) at the level of the coaxial tubes (4,5,6,7) and a means (13) for ensuring the maintenance of the tightness during the development of the telescopic arrangement (3). The means (12 and 13) cooperate advantageously to impose the development of the coaxial tubes (4,5,6,7) in a determined order of succession, which improves the rigidity of the device and permits of obtaining a systematic emergence of a part of the latter into the open air.

6 Claims, 3 Drawing Figures

FIG.1

BURIED SYSTEM COMPRISING A SIGNALIZATION DEVICE

The invention relates to a buried system comprising a signalization device constituted by a telescopic arrangement of coaxial tubes and comprising means for increasing the internal pressure in order to develop the telescopic arrangement, and means for controlling the increase of internal pressure from a predetermined instant.

Such a system is known from French Pat. No. 2,351,378. In this patent, which relates to a means for signalization of the operation of a machine normally buried in the soil, a telescopic arrangement of coaxial tubes is susceptible to be developed under the influence of one or two pyrotechnical development charges, whose ignition leads to an increase of internal pressure for forcing the development of the telescopic arrangement and to overcome the resistance of the soil in which the machine is buried, the telescopic arrangement emerging at the end of the development into the open air. This telescopic arrangement is formed without any means for ensuring tightness and a first disdvantage of such a system is that it then requires a considerable increase of internal pressure of the order of 500 bar and even up to 3000 bar in order that the telescopic arrangement in practice has the possibility to emerge into the open air. This increase of internal pressure implies an excess of pyrotechnical charge in order to compensate for the lack of tightness without an emergence into the open air of the telescopic arrangement being guaranteed with certainty; in a configuration buried in a hard soil, in fact the leakage may be very substantial. On the contrary, in a mine configuration placed on the soil or level with the soil, the excess of pyrotechnical charge may lead to such a violent ejection of the telescopic arrangement that the latter is torn off its support and is thrown away over a large distance.

The invention provides a system of the aforementioned kind which does not suffer from the first limitation.

Therefore, the buried system comprising a signalization device of the type mentioned in the opening paragraph is characterized in that the signalization device additionally comprises means for obtaining the tightness of the telescopic arrangement at the level of coaxial tubes and a means for ensuring the maintenance of the said tightness during the development of the telescopic arrangement. In fact, when the tightness is obtained and maintained, it is clear that the internal pressure is controlled. It then suffices to have a comparatively moderate pressure (30 to 100 bar) to penetrate the soil and emerge into the open air. When this tightness is maintained, this leads to the telescopic arrangement systematically emerging into the open air.

According to a preferred embodiment of the invention, the means for obtaining the tightness of the telescopic arrangement are toric joints disposed around the coaxial tubes.

According to one of the features of the invention, the means for ensuring the maintenance of the tightness inside the telescopic arrangement consists of a washer which is fixed at the top of the central coaxial tube and whose edges bear on the top of the outer coaxial tube.

On the other hand, the known system has a second disadvantage, i.e. when considering the well-known formula $F=Ps$ for a given pressure P, the applied force F is the larger as the surface s on which the pressure is exerted is larger. Thus, the internal pressure, which is exerted on the bases of the different coaxial tubes, logically takes along in the first place the coaxial tube whose base has the largest surface, this tube being the outer tube of larger diameter. In these conditions, the tube, which projects from the first tube and of course is hollow, has many possibilities of being filled, for example with earth, due to an effect similar to that which would be obtained during a drilling operation, which results in a filling-up operation, thus preventing the normal development of the other coaxial tubes.

In order to avoid this particularly great disadvantage when the number of tubes is larger than two, the invention provides a buried system which is characterized in that the means for obtaining the tightness in cooperation with the means for ensuring the maintenance of the said tightness impose a development of the coaxial tubes in a given order of succession.

For the same purpose and according to another aspect of the invention, the buried system is distinguished from the known system in that the means for ensuring the maintenance of the tightness in cooperation with the means for obtaining the said tightness constitutes an anti-return system for the coaxial tubes.

In fact, the outer tube is the first to ascend (this tube having the base of largest surface so that the force applied thereto is largest) and when it begins to ascend, it automatically takes along the central tube, the washer fixed to the central tube bearing on the edges of the outer tube; the other coaxial tubes follow simultaneously due to the friction imposed by the toric joints or rings (the frictional forces having modules larger than the differences of the modules of the forces applied to two adjacent coaxial tubes). Thus, if the telescopic arrangement has n coaxial tubes, the n coaxial tubes will ascend simultaneously. The outer tube stops ascending when it has performed its maximum stroke. Of the $n-1$ remaining coaxial tubes, the outermost tube of the group is subjected to the largest force due to the fact that its base surface is now largest; it thus continues to ascend taking along the central tube owing to the washer which also bears on its edges, the other coaxial tubes being likewise taken along due to the frictional forces. When the next to the outermost tube has performed in turn its maximum stroke, it stops and the remaining tubes continue to ascend according to the same principle, and so on, until only the central tube is left, which stops in turn when it has reached its maximum stroke.

Thus, a seal is provided between each tube and its adjacent outer tube and the tightness maintained. Due to the fact that the n tubes, and then the $n-1$ tubes etc. ascend simultaneously, the system is given a high rigidity, which is an additional advantage for a systematic emergence of the telescopic arrangement.

On the other hand, the washer, which constitutes the means for ensuring the maintenance of the tightness serves at the same time as an anti-return system; filling up, for example with earth, is no longer possible; the different tubes then ascend simultaneously excluding any possibility of jamming or even of recoiling due to a filling-up.

In order that the invention may be readily carried out, it will now be described more fully, by way of example, with reference to the accompanying drawings, in which.

Figure 1:
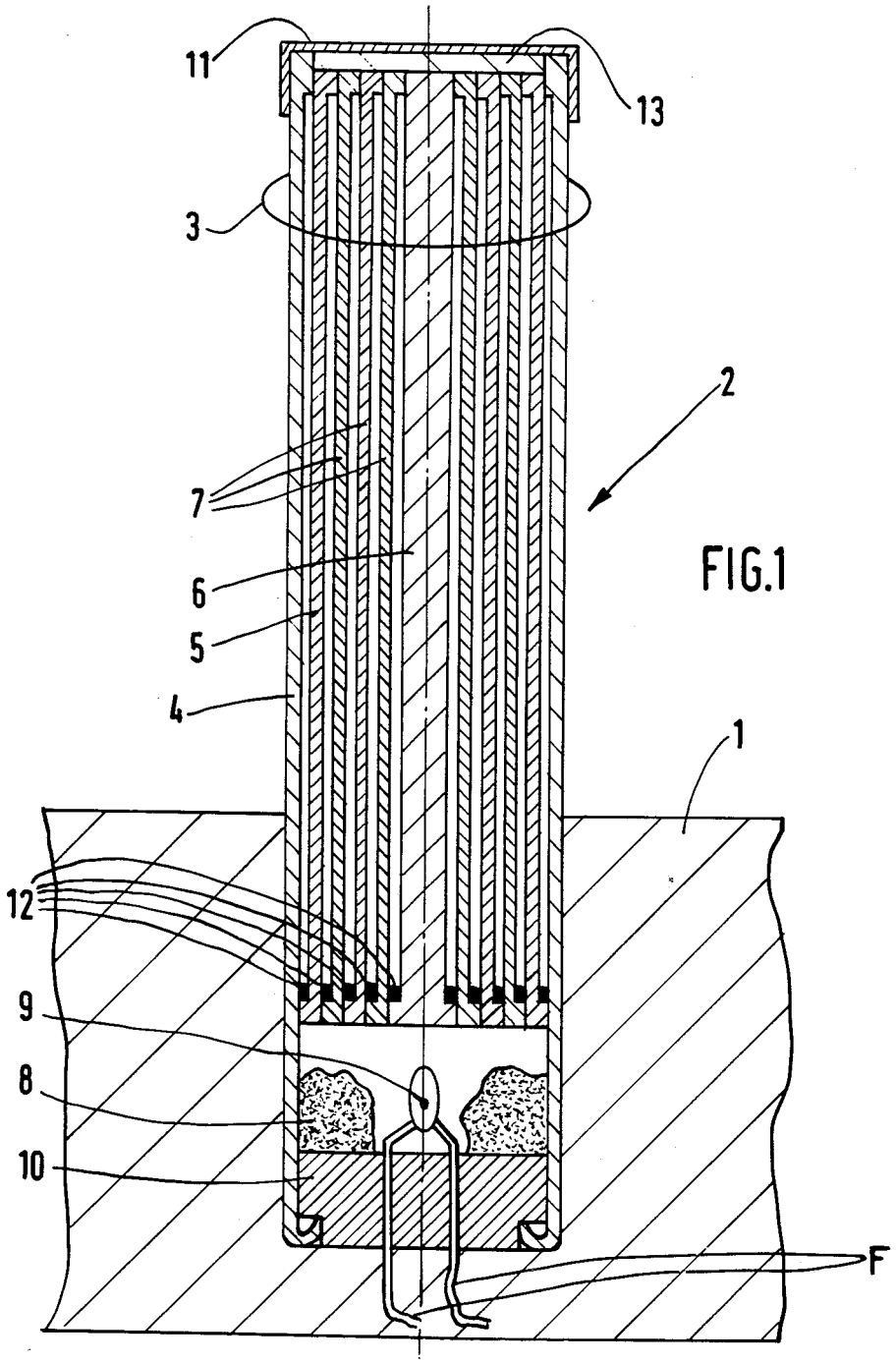
FIG. 1 is a sectional view of the buried system, of which the signalization device is shown in its rest position.

FIG. 1 shows the buried system 1 comprising a signalization device 2 shown in its rest position. The signalization device 2 is constituted on the one hand by a telescopic arrangement of coaxial tubes 3, which is in turn constituted by a cylindrical envelope 4 fixed with respect to the buried system 1, by an external movable tube 5, by a central movable tube 6 and by a plurality of intermediate tubes 7 (three intermediate tubes 7 are shown in the Figure; this number is evidently not limitative). The coaxial tubes, which consequently have decreasing diameters, are correctly adjusted with respect to each other. The signalization device 2 comprises on the other hand means 8 for increasing the internal pressure in order to develop the telescopic arrangement 3 and means 9 for controlling the increase of the internal pressure from a predetermined instant. In a preferred embodiment of the system according to the invention, the means 8 are formed by a gas-generating composition, which may be, for example, black powder of the type PH6, propergol or any other slow composition that can produce a overpressure within the cylindrical envelope 4, while the means 9 are formed by an electric igniter, which inflames the gas-generating composition 8 at a predetermined instant. An obturator 10 closes hermetically the base of the cylindrical envelope 4, which serves at the same time as a support for the electric igniter 9. Finally, a closure hood 11 closes non-hermetically the upper part of the cylindrical envelope 4. According to the invention, the signalization device 2 moreover has means 12 for obtaining the tightness of the telescopic arrangement at the level of the coaxial tubes and a means 13 for ensuring the maintenance of the said tightness during the development of the telscopic arrangement. In a preferred embodiment of the invention, the means 12 are formed by toric joints or rings disposed around the coaxial tubes and the means 13 is a washer, which is fixed at the top of the central coaxial tube 6 and whose edges bear on the top of the outer coaxial tube 5 and hence also on the edges of the intermediated coaxial tubes 7.

The signalization device can particularly and advantageously be used in electronic anti-tank mines. This kind of mines has an activity period arbitrarily limited in time, at the end of which it returns to the safe state. This passage to the safe state is not perceptible at all and it may prove useful to detect it by a state indicator, which in this case is constituted by the signalization device 2; the state indicator has for its object to visualize the safe state, thus permitting of removing the mines or of traversing its own mine field.

Thus, when the mine is electrically place in the safe state after a predetermined time, which may be, for example, 30 days, the electric igniter 9 is ignited inflaming the gas-generating composition 8 and thus leading to the increase of the internal pressure. When the pressure increases within the cylinderical envelope 4, the telescopic arrangement of coaxial tubes 3 is developed in the given order of succession. The n movable tubes then ascend simultaneously due to the principles described above as far as the maximum stroke of the outer coaxial tube 5, whereupon the (n−1) remaining tubes in turn ascend, and so on, until the central coaxial tube 6 completely emerges. Thus, a systematic emergence of the signalization device 2 is obtained due to the rigidity given to the device and due to the maintenance of the tightness in the device without departing from the idea that it is easier to raise and break an earth layer in a gradual manner than to do so in an abrupt and quasi instantaneous manner. The delay of execution of the operation, which may range from a few seconds to several minutes, according to the nature of the soil met, is not critical for the user knowing that the activity period of a mine is measured in days or in months.

Consequently, it should be noted that it is advantageous to choose slow gas-generating compositions. If there is no or no longer any resistance above the device 2, more particularly if the mine is almost uncovered, the pressure of the gases as the simple effect of compensating the weight of the tubes and their friction, the device 2 then being slowly extended to its maximum length. If the mine is buried deeper or if the earth layer under which it is buried is harder, there is exerted on this earth layer a pressure which is proportional to its resistance. Then the soil cracks, while the stones that may be present in the path of the device 2 are displaced and the device 2 is extended to its maximum length.

In a preferred embodiment of the system according to the invention, the buried system, which has on the other hand an electrical connection essential to its original or primary operation, is characterized in that a means is provided for causing the electrical connection essential to the original operation to be cut. The means for causing the electrical connection essential to the original operation of the buried system to be cut is preferably the electric igniter of the signalization device, with which the said electrical connection is arranged in series.

In fact, the buried system, which comprises a signalization device, has at least one original function associated with it. In case of use in an electronic anti-tank mine, this mine has a firing device, which is ignited upon the passage of a vehicle. Thus, an electrical connection is essential for permitting the operation and the triggering of the system. During the passage of the mine to the safe state, on the one hand, the signalization device is extended in order to permit the visualization of this state and on the other hand, the electrical connection essential to the operation of the buried system is cut; more particularly when this system is a mine, the electrical connection to the firing system of the military charge is cut. Therefore, this electrical connection F essential to the operation of the buried system 1 is connected in series with the electric igniter 9 of the signalization device 2 in such a manner that, when the electric igniter inflames for terminating the development of the telescopic arrangement 3, the electrical connection F is simultaneously interrupted, the electric igniter having operated as a fuse under the influence of heat. Thus, the operation of the signalization device is a supplementarly and unambiguous proof of the safe state, even in the very improbable case of an accidental ignition of the electric igniter 9. In fact it would be intolerable that the signalization device in these circumstances gives a false indication.

According to a variation not shown in the drawing, the electrical connection essential to the original operation is a conducting fuse wire passing along the contour of the electric igniter 9 and then melting under the influence of the heat released by the latter during its ignition.

According to another variation not shown in the drawing, the electrical connection essential to the original operation is a conducting wire integral with a point of the central tube 6, for example hooked to the base of the central tube, which is interrupted during the development of the telescopic arrangement 3.

Figure 2:
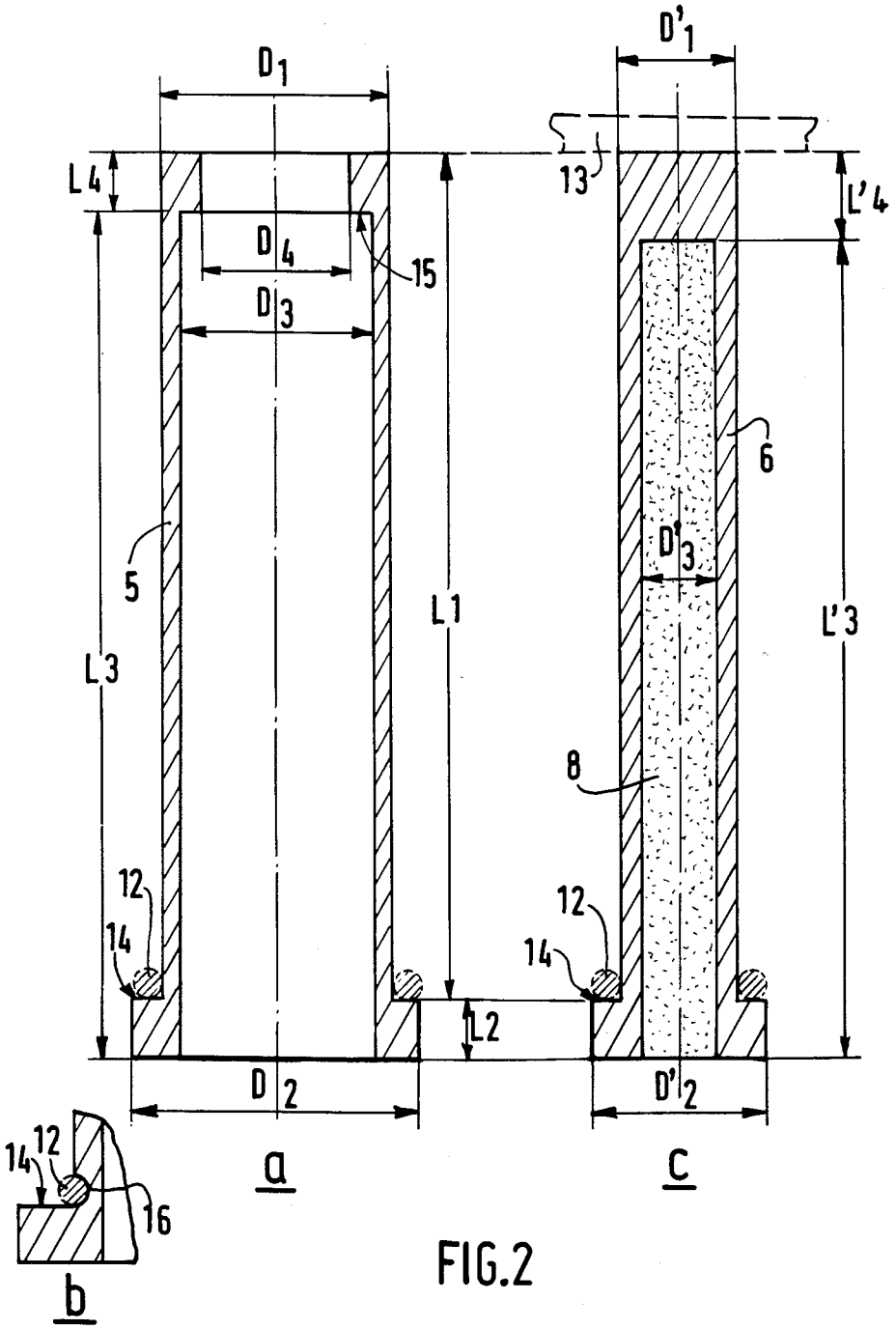
FIGS. 2a, 2b and 2c show in detail an embodiment of coaxial tubes of the telescopic arrangment.

FIG. 2*a* shows in detail an embodiment of a coaxial tube of the telescopic arrangement, which may be the outer coaxial tube 5 (FIG. 1) or an arbitrary intermediate tube 7, a central coaxial tube being shown in FIG. 2*c*. The detail of a variation described with reference to FIGS. 2*a* and 2*c* is shown in FIG. 2*b*.

In FIG. 2*a*, the outer coaxial tube 5 (for example) is shown in sectional view. This tube has a diameter D1 over the greatest length designated by L1; over its length L2 it has an outer shoulder 14 having a diameter D2 (D2>D1), on which bears the toric joint 12 indicated by dotted lines. It is bored out to an outer diameter D3 (D3<D1) over its length L3 and to a diameter D4 (D4<D3) over its length L4, an inner shoulder 15 thus being obtained, on which the toric joint of the coaxial tube having a diameter just smaller than that of the tube shown in the drawing will collapse. At the end of the development of the tube having a just smaller diameter, the toric joint is compressed between the inner shoulder 15 of the tube shown in the drawing and the outer shoulder of the tube having a just smaller diameter, the joint continuing to ensure the tightness, while the adjacent coaxial tubes remain integral with each other by means of their inner and outer shoulders.

According to a variation, of which the detail is shown in FIG. 2*b*, the toric joint 12 can be placed in part in a recess 16, which then would be situated above the shoulder 14 of an arbitrary coaxial tube 5, 6, 7.

FIG. 2*c* shows an embodiment of the central coaxial tube 6, which is represented in sectional view. This tube has a diameter D'1 over its length L1; it also has an outer shoulder 14 having a diameter D'2 (D'2>D'1) over its length L2, on which bears the toric joint 12 (shown in dotted lines). In priciple, and as shown in FIG. 1, the central coaxial tube is filled throughout its length. However, FIG. 2*c* shows a variation of the central coaxial tube, which is bored out to an inner diameter D'3 (D'3<D'1) over its length L'3, but remains filled over its length L'4. According to a characteristic of the system thus obtained, the means for increasing the internal pressure are arranged within the bore of the central coaxial tube, which is bored out without an opening. In fact, in order to advantageously produce an even slower chemical reaction and to control more accurately its speed, the gas-generating composition 8 may preferably be disposed within the central coaxial tube 6, as shown in FIG. 2*c*, instead of being disposed on the obturator 10, as shown in FIG. 1. The top of the central coaxial tube 6 has fixed to it the washer 13, which constitutes the means for ensuring the maintenance of the tightness. The means for fixing the washer 13 is obtained in fact by welding; it may alternatively be obtained simply by screwing.

Figure 3:
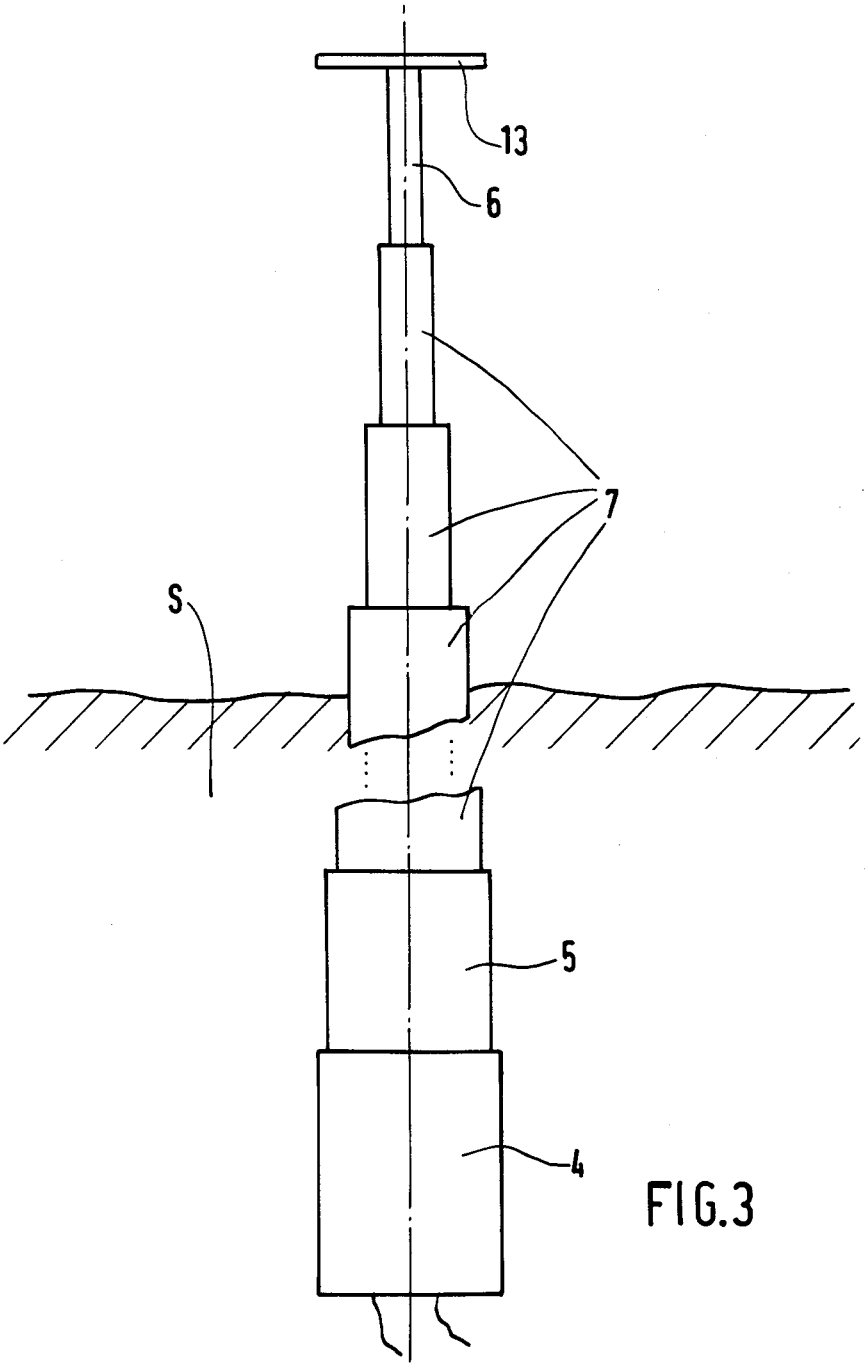
FIG. 3 shows the signalization device of the buried system in its extended position.

FIG. 3 shows the signalization device 2 of the buried system in its extended position. The fixed cylindrical envelope 4 as well as the outer coaxial tube 5 and a part of the intermediate coaxial tubes 7 remain buried in the soil S, while the other part of the intermediate coaxial tubes 7 and the central coaxial tube 6, on which the washer 13 is fixed, emerge from the soil and are in the open air, thus signalizing the position of the buried system.

In order to increase the marking effect, the contrast with the outer environment can be inproved by utilizing coaxial tubes of different colours.

Another possible use of such a device could be a remote controlled mine antenna.

I claim:

1. A buried system with a primary operation comprising a signalization device including a telescopic arrangement of a plurality of coaxial tubes and comprising means for increasing the internal pressure in order to develop the telescopic arrangement, means for controlling the increase of the internal pressure from a predetermined instant, means for providing a seal between each tube and its adjacent outer tube thereby providing tightness to the telescopic arrangement and means for ensuring the maintenance of tightness during the development of the telescopic arrangement, said means for providing tightness to the telescopic arrangement being toric joints or rings disposed around the coaxial tubes and said means for ensuring the maintenance of tightness within the telescopic arrangement being a washer, which is fixed at the top of the central coaxial tube and whose edges bear on the top of the outer coaxial tube.

2. A buried system as claimed in claim 1, wherein the means for obtaining the tightness in cooperation with the means for ensuring the maintenance of tightness impose a development of the coaxial tubes in a determined order of succession.

3. A buried system comprising a signalization device as claimed in claim 2, wherein the means for ensuring the maintenance of tightness in cooperation with the means for providing tightness constitutes an anti-return system for the coaxial tubes.

4. A buried system comprising a signalization device as claimed in claim 3, wherein the buried system has an electrical connection for providing said primary operation, and wherein means is provided for causing the electrical connection to be cut.

5. A buried system comprising a signalization device as claimed in claim 4, said signalization device having an electric igniter, and wherein the means for causing the electrical connection to be cut is the electric igniter.

6. A buried system comprising a signalization device as claimed in claim 5, in which the central coaxial tube of the telescopic arrangement is bored out without an opening, and wherein the means for increasing the internal pressure are disposed within the bore of the central coaxial tube.

* * * * *